United States Patent [19]

Tourigny

[11] Patent Number: 4,895,280

[45] Date of Patent: Jan. 23, 1990

[54] PRESSURIZED FLUID REMOTE DISPENSER INCLUDING IMPROVED LOCKING MEANS

[75] Inventor: Jay S. Tourigny, West Hartford, Conn.

[73] Assignee: Microcare Chemical Corporation, Bristol, Conn.

[21] Appl. No.: 225,044

[22] Filed: Jul. 27, 1988

[51] Int. Cl.[4] ..... B65D 83/00

[52] U.S. Cl. ..... 222/402.13; 222/545; 138/110; 239/588; 285/82

[58] Field of Search ..... 222/153, 402.13, 402.14, 222/402.22, 402.23, 545, 153, 394, 567; 239/588, 573, 337; 138/110, 109, 118.1; 285/82, 81, 88, 87, 8; 401/190

[56] References Cited

U.S. PATENT DOCUMENTS

| | | | |
|---|---|---|---|
| 2,863,167 | 12/1958 | Nordin | 138/118.1 |
| 3,650,438 | 3/1972 | Stephenson et al. | 222/402.22 |
| 4,278,188 | 9/1982 | Stephenson et al. | 222/182 |
| 4,350,299 | 7/1981 | Stephenson et al. | 239/337 |
| 4,682,713 | 7/1987 | Clapp | 222/402.14 |

FOREIGN PATENT DOCUMENTS

| | | | |
|---|---|---|---|
| 329926 | 12/1920 | Fed. Rep. of Germany | 285/82 |
| 2273594 | 1/1976 | France . | |

*Primary Examiner*—Joseph J. Rolla
*Assistant Examiner*—Kenneth Noland
*Attorney, Agent, or Firm*—Victor E. Libert

[57] ABSTRACT

A remote dispenser is provided for use in a pressurized fluid-dispensing assembly including a base unit, which may be an aerosol container having a fluid release device to which the remote dispenser is connected by a supply tube inserted into a discharge outlet of the base unit. A resilient, wire clip is secured to the supply tube, resiliently engages a retainer seat on the base unit and holds the release device in its open, fluid discharging position. Inadvertent disengagement of the supply tube from the base unit also disengages the wire clip, to allow the release device to automatically return to its normal, closed position. The clip exerts positive gripping strength and has a stop to hold it against pivoting. These factors serve to reduce the likelihood of inadvertent disengagement of the clip by pulls on the supply tube.

11 Claims, 3 Drawing Sheets

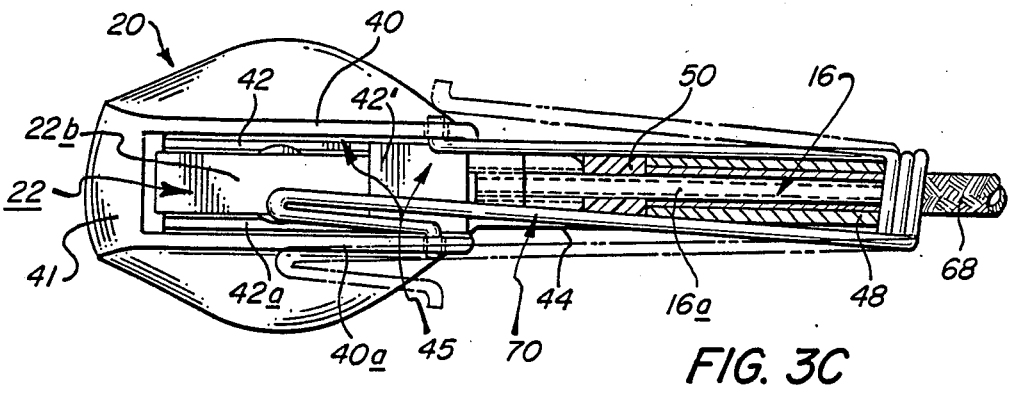
FIG. 3C
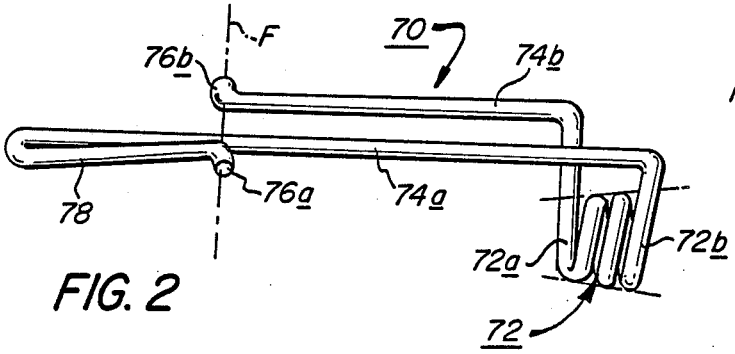
FIG. 2
FIG. 2A
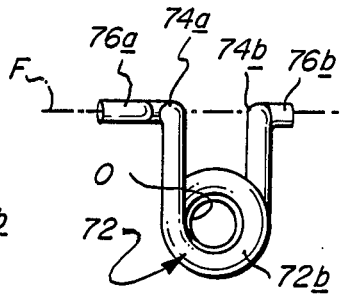
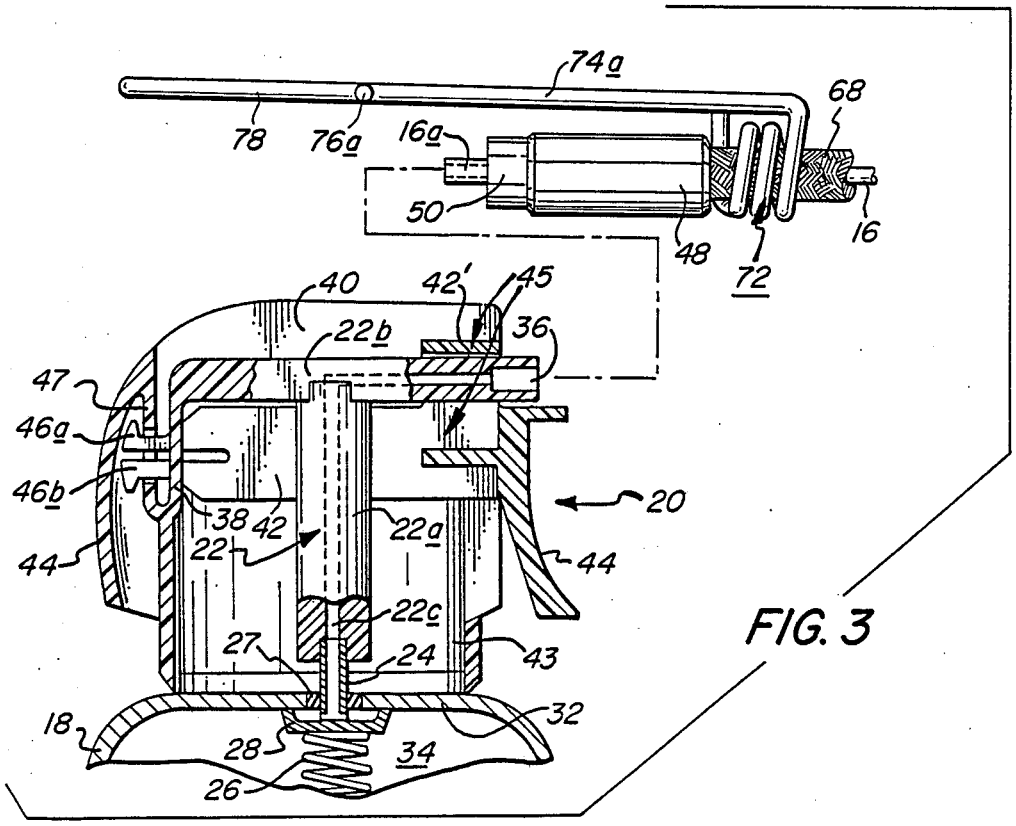
FIG. 3

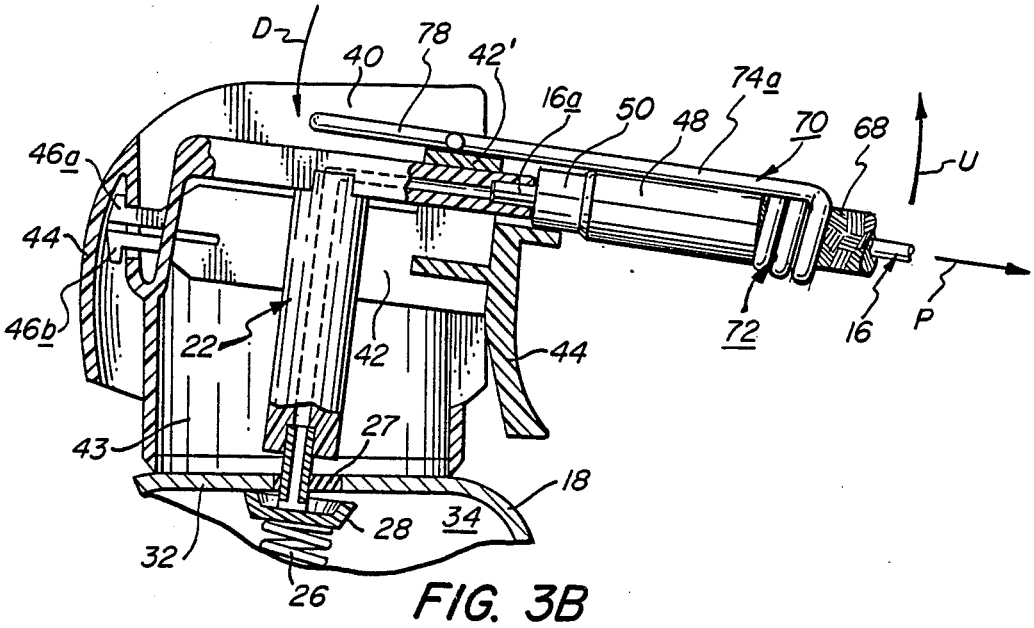
FIG. 3B
FIG. 4
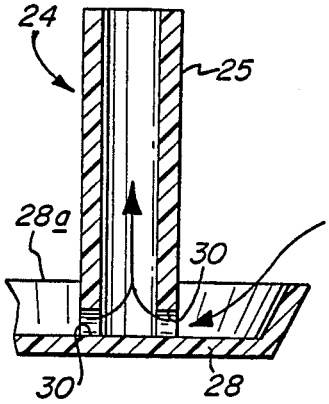
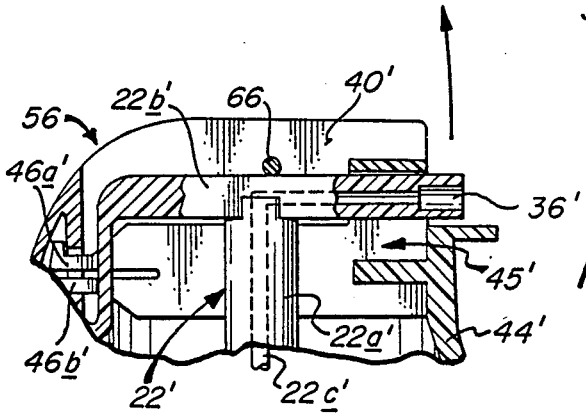
FIG. 5

PRESSURIZED FLUID REMOTE DISPENSER INCLUDING IMPROVED LOCKING MEANS

BACKGROUND OF THE INVENTION

1. Field Of The Invention

The present invention is concerned with remote dispensers for base units containing a pressurized fluid, and to assemblies comprising remote dispensers connected to such base units by a flexible supply tube. Such devices find use in industrial applications for a variety of cleaning or other uses involving the delivery to a workpiece of a controlled spray of a substance, such as a solvent, cleaner or antistatic substance, from a pressurized container base unit, such as a conventional aerosol spray can.

It is often convenient or necessary, because of space limitations and to reduce operator fatigue, to utilize a remote dispenser attached to a pressurized base unit when it is desired to deliver a spray of a substance, for example, a solvent liquid for removing solder from and otherwise cleaning defective circuit boards to permit re-use of the boards in a manufacturing process. Other typical uses of such remote dispensers are for cleaning internal components of optical devices (cameras, projectors, telescopes, etc.) and electronics equipment (tape recording heads, etc.), and for cleaning or lubricating internal gears, electric motors and controls and the like. In such cases the manipulation of a conventional pressurized container containing a pound (0.45 kg) or more of solvent, cleaning agent or other material is often awkward or impossible in tight quarters. The remote dispenser has a trigger or other manual control to dispense the pressurized fluid. In addition, an "off" and "on" control on the base unit container is desirable in order to provide a shut-off means at the source of supply when the assembly is not in use.

2. Description Of The Related Art

Stephenson et al U.S. Pat. No. 3,650,438 shows a pressurized container assembly having a remote manually-operated nozzle wand dispenser connected by flexible tubing to an aerosol container base unit. The output supply of the base unit is controlled by a twistable container cap means mounted on it, the cap means permitting manual opening and closing of the spray nozzle of the base unit. Stephenson et al U.S. Pat. Nos. 4,278,188 and 4,350,299 each disclose an assembly consisting of an aerosol can connected by flexible tubing to a wand-like remote delivery nozzle which is equipped with a brush at the end thereof.

The flexible tubing used to provide a supply tube connecting the base unit to the remote dispenser may be connected to the aerosol can by being secured to a cap assembly which is specifically designed to accommodate it. However, such custom design increases manufacturing costs. On the other hand, the supply tube end may be simply inserted into the discharge bore of a conventional or off-the-shelf spray nozzle on the base unit. For reasons of economy it is desirable to use off-the-shelf stock plastic tubing and stock aerosol spray can nozzles; however, manufacturing tolerances for such stock items are such that the inserted tubing may readily be accidentally disengaged from the discharge bore of the base unit during movement of the remote dispenser by the operator, especially if the remote dispenser (which may be fitted with a brush) is used with a scrubbing motion. The nozzle on the base unit aerosol spray container must be locked in the open or discharge position in order to provide a steady supply of fluid to the remote dispenser. Accordingly, accidental disengagement of the supply tubing from the discharge bore of the nozzle of the aerosol spray container base unit results in a wasteful and possibly hazardous continuous discharge from the base unit until its nozzle can be closed or the delivery tube reinserted.

Clapp U.S. Pat. No. 4,682,713, assigned to the assignee of this application, addresses this problem by providing a locking means secured to the supply tube. The locking means is inserted into a seat on the base unit and serves to retain the fluid release valve in the open position, in order to continuously supply pressurized fluid to the remote dispenser. The locking means is designed so that inadvertently or deliberately pulling the supply tube from the base unit discharge bore also pulls the locking means from its seat, thereby releasing the fluid release valve to return to its normal, closed position and shut off the discharge of pressurized fluid from the disconnected base unit. The locking means of the '713 Clapp Patent may comprise a flexible rod (50 in FIGS. 1, 2, 3 and 4 of the '713 Patent) or a wedge-like member (72 in FIGS. 6, 7 and 8 of the '713 Patent). The structure of the '713 Patent is useful for the intended purpose. However, to attain reliable performance it is necessary to carefully control the length and flexibility of the rod 50 of the FIGS. 1–4 embodiment; otherwise, a sharp upward pull on the supply tube (16/68 in FIG. 1 of the '713 Patent) might pivot the tube upwardly and disengage it from discharge bore 36 without fully withdrawing locking means 50 from the aligned apertures of sidewalls 40, 40a. In such case, the release means would remain open and discharge fluid from the disconnected base unit. With respect to the wedge-shaped locking means 72 of the FIGS. 6–8 embodiment of the '713 Patent, it requires the provision of tabs (70 in FIGS. 6–8) or other custom structures on the release means in order to retain the locking means in place. While both illustrated embodiments of the '713 Patent are functional, the strength of the securement of the locking means (50 or 72) to the release means (20 or 20″) is limited, especially if the fit of supply end 16*a* of tube 16 into discharge bore 36 is a loose one. Inadvertent disconnections of the supply tube, even if infrequent, result in annoyance and interruption, notwithstanding that unwanted discharge of pressurized fluid from the disconnected base unit was usually prevented by disengagement of the locking means.

The present invention overcomes the foregoing problems and provides a remote dispenser having an improved locking means.

SUMMARY OF THE INVENTION

In accordance with the present invention, there is provided, in a remote dispenser for dispensing a pressurized fluid from a base unit defining a chamber containing the pressurized fluid, an improvement as described below. The base unit is one having mounted thereon release means including (i) a valve assembly having a discharge bore in flow communication with the chamber, (ii) a displaceable member moveable between a normally closed position, in which flow of pressurized fluid through the discharge bore is blocked, and an open position in which the discharge bore is open to such flow, and (iii) a support means carrying a retainer seat positioned adjacent the displaceable member. The remote dispenser includes (i) a supply tube having a supply end dimensioned and configured to be slidably and removably connected in fluid flow communication with the discharge bore, and (ii) locking means secured to the supply tube at the supply end thereof and seatable in the retainer seat of the support member, the locking means being dimensioned and configured so that, when seated within the retainer seat, the locking means retains the displaceable member in its open position and secures the supply tube to the discharge bore. The improvement in the aforesaid arrangement is that the locking means comprises a clip member having (1) an anchor portion within which the supply tube is retained; (2) a pair of spaced-apart, resilient, opposed legs (the clip member being dimensioned and configured so that, (i) when the legs are compressed and then released to resiliently engage the retainer seat, the clip member resiliently grips and thereby engages the support member, and (ii) the clip member is disengageable therefrom by further compression of the legs to disengage them from the retainer seat); and (3) a stop member dimensioned and configured to restrict pivoting movement of the locking means relative to the supports means when the locking means is engaged therewith.

Other aspects of the invention provides one or more of the following features in a given embodiment of the invention: the anchor portion of the clip member may comprise a bight from which each of the opposed legs extends; each of legs may terminate in a detent foot to provide a pair of detent feet dimensioned and configured to engage retainer seat; such detent feet define a fulcrum portion of the locking means and the stop member and anchor (bight) portion extend away from the fulcrum portion on opposite sides thereof.

In yet another aspect of the present invention, the locking means is comprised of resilient wire and the bight portion comprises a coiled segment of the wire defining a coil aperture having an inside diameter, the supply tube being received within the coil aperture. The stop member may comprise a U-bent portion of one of the legs of the clip member and a ferrule may be affixed to the supply end of the supply tube, the ferrule having an outside diameter greater than the inside diameter of the coil aperture.

The present invention also provides for an assembly of a base unit as aforesaid connected by a supply tube to a remote dispenser as aforesaid.

Other aspects of the invention will be apparent from the following description and the drawings.

As used herein and in the claims, reference to the supply end of the supply tube being "slidably and removably connected" to the discharge bore or the like, means that the connection is made by insertion of one member into another, and may be unmade by slidably withdrawing the tube.

BRIEF DESCRIPTION OF THE DRAWINGS

FIG. 2 is a perspective view of a clip member comprising one embodiment of the locking means of the present invention;

FIG. 2A is an end view in elevation of the bight portion of the clip member of FIG. 2;

FIG. 3 is a section view in elevation of the release means and the top segment of the base unit of the assembly of FIG. 1 showing the release means in its normal, valve closed position, and showing the supply end of the supply tube and its associated locking means disengaged therefrom;

FIG. 3B is a cross-sectional view in elevation of the release means of FIG. 3, showing the supply tube connected thereto and the release means held in its open position by the locking means being engaged therewith;

FIG. 3C is a plan view of the release means of FIG. 3B;

FIG. 4 is a partial elevation view in section and on an enlarged scale of a stem valve forming a part of the release means of FIG. 3; and FIG. 5 is a partial elevation view in section of the outlet release means of the remote dispenser of the assembly of FIG. 1, with the release means shown in its normal, valve closed position.

DETAILED DESCRIPTION OF THE PREFERRED EMBODIMENTS

The remote dispenser of the present invention, and assemblies including the same, may utilize as the base unit a conventional pressurized aerosol spray can having a conventional, manually actuatable discharge means thereon. Such discharge means conventionally comprise a stem valve having a delivery bore extending therethrough and include a flange and spring means arranged so that depression or tilting of the stem from its normally closed position permits entry of pressurized fluid from the interior of the spray can, through a metering orifice opened by the tilting or depressing action, and into the delivery bore of the valve for discharge from the discharge end of the bore. Such valves are well known in the art as shown, for example, by the aforesaid U.S. Pat. No. 3,650,438, and need not be described in detail herein. It is also known to provide on such aerosol spray cans a trigger as part of the discharge means to facilitate manual operation of the stem valve. Regardless of the specific valving and trigger configuration utilized, the aerosol spray unit thus has mounted thereon fluid release means, described herein simply as "release means", which include a displaceable member which is operative to move the base unit supply valve from its normally closed valve position to an open valve position for release of pressurized fluid, e.g., as an aerosol spray, from the base unit.

Figure 1:
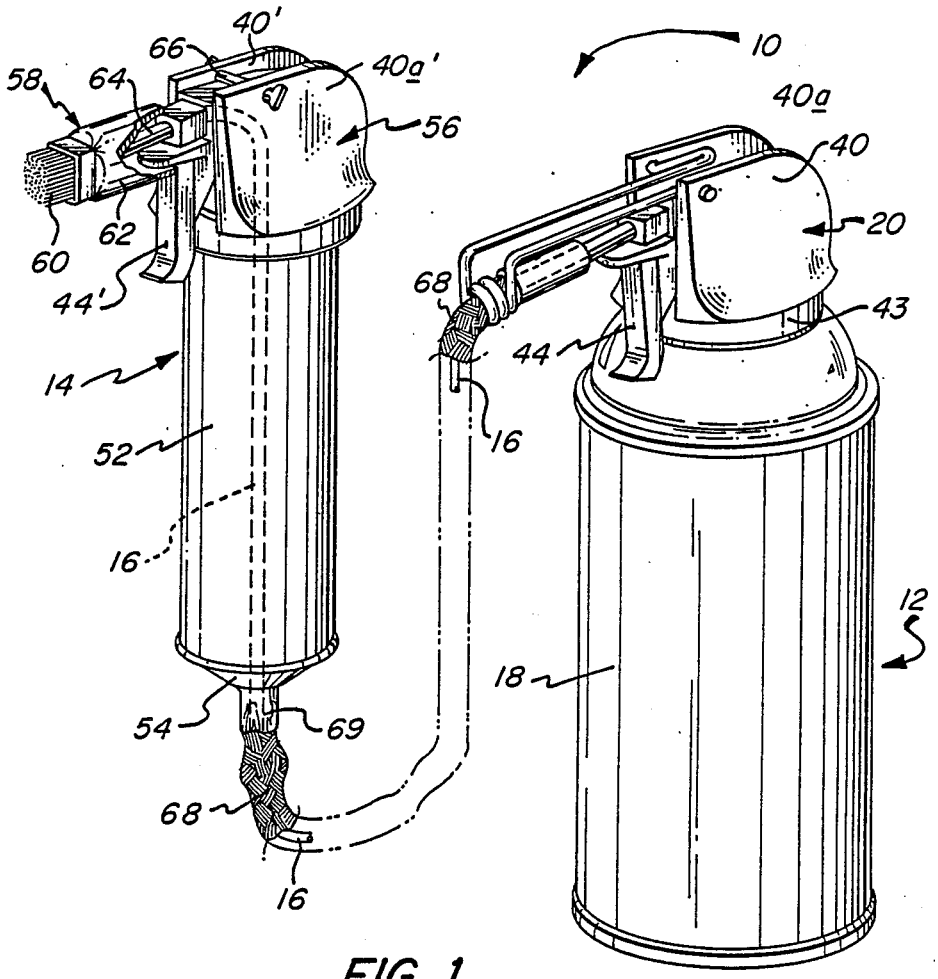
FIG. 1 is a perspective view of one embodiment of an assembly of a pressurized fluid base unit and a remote dispenser of the present invention.

Referring now to FIG. 1 there is shown an assembly generally indicated at 10 and comprising a base unit 12 which may comprise an aerosol spray unit, a remote dispenser 14 and a flexible supply tube 16 connecting base unit 12 in fluid flow communication with remote dispenser 14.

Base unit 12 includes a container 18, the interior of which provides a chamber for containing a fluid and pressurizing gas, as well known in the art, which pressurized gas serves to expel the fluid (which may be a liquid) contained within container 18 upon actuation of a release means generally indicated at 20. As best seen with reference to FIGS. 1 and 3, release means 20 serves as a cap for base unit 12 and comprises a displaceable member 22 (FIG. 3) of generally T-shaped configuration which comprises a component of a fluid supply valve assembly including a stem valve 24 (shown in part in enlarged scale in FIG. 4) having a spring 26 associated therewith and a stem 25 and base collar 28 which, when in the position illustrated in FIG. 3, seals off a delivery orifice 30 (FIG. 4) comprising apertures formed in the base of stem 25. Stem 25 is sealed in a gas-tight fashion by a flexible seal gasket 27 (FIG. 3) which seals an aperture (unnumbered) formed in the top wall 32 of the pressurized fluid-containing chamber 34 provided by container 18.

Figure 3A:
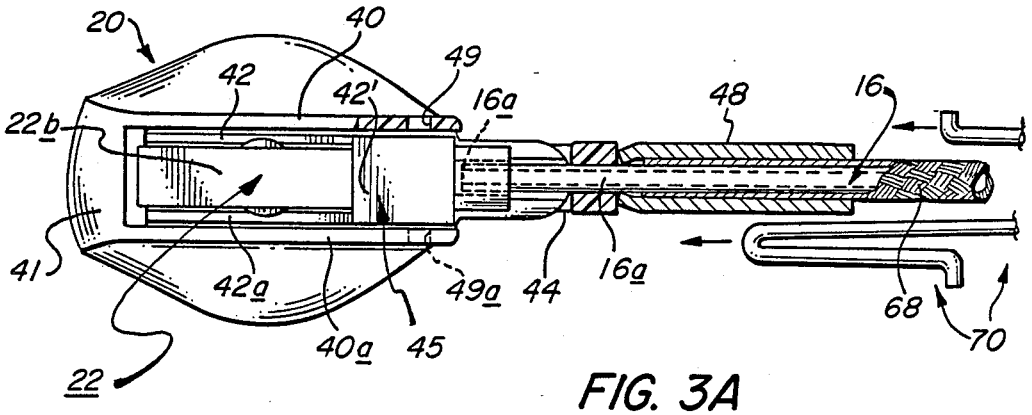
FIG. 3A is a plan view of the release means of FIG. 3, showing the release means in its normal, closed position with the supply tube connected thereto but the locking means disengaged.

Displaceable member 22 has a post portion 22*a* and a nozzle portion 22*b* which extends transversely of the post portion at the upper end thereof, as viewed in FIGS. 3 and 3B. A delivery bore 22*c* has an inverted L-shaped configuration and is connected in flow communication to stem valve 24 at one end and terminates in discharge bore 36 (FIG. 3) at the distal end of nozzle portion 22*b*. The end of nozzle portion 22*b* opposite the end containing discharge bore 36 terminates in a flexible hinge 38 which is integral with and carried on a support means 41 which includes, in the illustrated embodiment, a pair of upstanding, parallel spaced-apart sidewalls 40, 40*a* (best seen in FIGS. 1, 3A and 3C) with displaceable member 22 (FIGS. 3A and 3C) supported therebetween. Support means 41 includes a cylindrical-shaped base 43 which is integral with and supports sidewalls 40, 40*a*. A pair of aligned apertures 49, 49*a* (FIG. 3A) are formed, respectively, in sidewalls 40, 40*a* and provide a locking seat to receive a locking means, as described in more detail below.

A trigger plate 45 is connected to displaceable member 22 and is of generally U-shaped configuration in plan view as seen in FIGS. 3A and 3C and comprises a pair of parallel spaced-apart support plates 42, 42*a* connected by a web portion plate 42'. As shown in FIGS. 3A and 3C, web portion 42' extends over the top of nozzle portion 22*b* of displaceable member 22 and terminates in a trigger 44 extending between and securing support plates 42, 42*a*. The opposite, distal ends of support plates 42, 42*a* each terminate in a pair of tangs 46*a*, 46*b* as shown in FIGS. 3 and 3B. (Support plate 42*a* and its associated tangs are omitted from FIGS. 3 and 3B for clarity of illustration). Tangs 46*a* and 46*b* are received within an opening (unnumbered) formed in a web 47, which is integral with and part of support means 41, and terminates at the base of hinge 38 to cooperate therewith in forming a Y-shaped configuration in the section view of FIGS. 3 and 3A. Upon pressure being applied in a leftwardly and downwardly direction, as viewed in FIGS. 3 and 3A, by squeezing trigger 44, support plates 42, 42*a* will pivot downwardly about the opening in which tangs 46*a*, 46*b* are mounted, as shown in FIG. 3B. Such downward pivoting action tilts stem valve 24, thereby disengaging the shoulder rim 28*a* (FIG. 4) of base collar 28 from the underside of top wall 32, as shown in FIG. 3B, thereby permitting the pressurized fluid to escape from chamber 34 through delivery orifices 30 (as shown by the arrow in FIG. 4) thence through delivery bore 22*c* into discharge bore 36. Release of the pressure on trigger 44 will cause spring 26, which is supported in a conventional and well known manner not illustrated, to return displaceable member 22 to its normal, valve closed position.

Supply tube 16, as best seen in FIGS. 3, 3A and 3B, is contained within a suitable flexible, protective sheathing 68, which may be a woven metal wire sheathing, a fiber glass sheathing, or the like. Protective sheathing 68 serves to protect supply tube 16 against being burned through by contacting, for example, a soldering iron or the like, and from being inadvertently cut or damaged by sharp objects or tools.

As seen in FIG. 1, supply tube 16 extends to a handle means 52 which, in the illustrated embodiment, comprises a hollow cylindrical shaped chamber having a lower, closed end 54 through which supply tube 16 extends to an outlet release means 56 mounted on the upper, opposite end of handle 52. Supply tube 16 may be crimped by a fastener 69 to relieve strain on the discharge end of supply tube 16, i.e., its end which is connected to outlet release means 56 for discharge of the pressurized fluid onto the workpiece. Outlet release means 56 may be of similar or identical construction and operation as release means 20, and parts thereof corresponding to parts of release means 20 are identically named and identically numbered save for the addition of a price indicator, and therefore need not be described in detail. Thus, outlet release means 56 may comprise a trigger actuated aerosol spray valve means mounted in the upper end (as viewed in FIG. 1) of handle 52. In the embodiment illustrated in FIG. 1, a scrubber/applicator 58 comprising, in the illustrated embodiment, a bristle brush 60 mounted in a hollow cylindrical ferrule 62 is shown carried on a dispensing tube 64 which is received within the discharge bore 36' (FIG. 5) of nozzle portion 22*b'* of displaceable member 22' of outlet release means 56. Because scrubber/applicator 58 may be used with a vigorous scrubbing action, there is a danger that displaceable member 22' may be forced upwardly (in the direction of the arrow shown in FIG. 5) with sufficient force to damage outlet release means 56 or disengage tangs 46*a'* and 46*b'*. Accordingly, a stop means 66 (FIGS. 1 and 5) is mounted within a pair of aligned mounting apertures (unnumbered) formed in upstanding sidewalls 40', 40*a'* (FIGS. 1 and 5). Stop means 66 thus controls upward movement of displaceable member 22' to within its normal displacement range.

Referring now to FIGS. 2 and 2A, a locking means comprises a clip member 70 having an anchor portion comprising, in the illustrated embodiment, a bight portion 72 from which extend a pair of spaced-apart, resilient, opposed legs 74*a*, 74*b*. Leg 74*a* terminates in a detent foot 76*a* and leg 74*b* terminates in a detent foot 76*b*. In the illustrated embodiment, detent feet 76*a* and 76*b* are comprised of the terminal or distal ends of legs 74*a*, 74*b* which have been turned at about a 90° angle to the longitudinal axis of the legs, and lie in the same plane as legs 74*a*, 74*b*. Detent feet 76*a*, 76*b* are aligned along a common axis F and face outwardly of clip member 70, away from each other. A stop member 78 (FIG. 2) is provided, in the illustrated embodiment, by a torsion loop, that is, by a U-bent section formed in leg 74*a*. As best seen in FIGS. 2, 3A and 3B, the U-bent section may be formed from the same piece of material from which leg 74*a* is formed, by simply bending it back on itself.

Legs 74*a* and 74*b* are resilient, that is, in their relaxed or unstressed state they define a V configuration as shown in dash outline in FIG. 3C and are constructed so that they will resist "compression", i.e., will resist pressure applied to them which would tend to force the legs closer together, much in the manner of a safety pin. Thus, a convenient form of construction is that illustrated in FIGS. 2 and 2A, wherein clip member 70 is formed of a single unitary piece of resilient wire, such as a carbon steel wire or other wire having a spring-like resiliency, and may be suitably metal-plated to provide a smooth, bright finish. As illustrated, clip member 70 comprises a single, integral length of wire which has a coil formed at an intermediate portion thereof to provide bight portion 72, and is bent on itself to form opposed legs 74*a* and 74*b*. A segment of leg 74*a* is bent back upon itself to form U-bent stop member 78 and the extreme distal ends of the wire are turned at about 90° to the longitudinal axes of their associated legs to provide detent feet 76*a* and 76*b*. Bight portion 72 is preferably coiled in such a manner that the coil has a generally conical profile as suggested by the dash lines of FIG. 2. In this manner, the inside diameter of the opening O (FIG. 2A) of bight portion 72 is larger at base coil 72*b* than it is at apex coil 72*a*. This preferred construction facilitates the insertion of a sheathed supply tube through the bight portion 72 of clip member 70, as described below.

A length of supply tube 16, encased by a protective sheathing 68, is inserted through bight portion 72 by passing the supply end 16*a* of the sheathed tubing through bight portion 72, in the direction moving from base coil 72*b* towards and through apex coil 72*a*. A ferrule 48 is then fitted over the end portion of sheathing 68 and crimped over sheathing 68 and the portion of tube 16 encased therein, leaving a length of supply end 16*a* to protrude beyond ferrule 48. A suitable compressible gasket 50, such as one made of Neoprene rubber, is then slipped over supply end 16*a* of tubing 16 and abutted against ferrule 48, leaving a remaining protruding length of supply end 16*a* in the finished assembly, as shown in FIG. 3. The outside diameter of ferrule 48 is greater than the diameter O of the opening of bight portion 72, so that the construction illustrated in FIG. 3 results, with clip member 70 being secured to sheathed supply tubing 16 by ferrule 48, which serves as a stop which prevents the withdrawal of sheathed supply tube 16 from clip member 70, while leaving clip member 70 to be free to be slidably moved along sheathed supply tube 16 in a direction away from ferrule 48.

In order to connect supply tube 16 to release means 20, the locking means provided by clip member 70 is slid a short distance along supply tube 16 away from ferrule 48, as illustrated in FIG. 3A, so as not to interfere with making the connection. The supply end 16*a* of tube 16 is then inserted into discharge bore 36, as suggested by the dash line in FIG. 3, by simply sliding the tube in place to effectuate a force fit, tube 16 being inserted well into discharge bore 36, as shown in FIG. 3A. Trigger 44 is then depressed to move displaceable member 22 to its open position (which is illustrated in FIG. 3B). While keeping trigger 44 in its depressed, open position, the locking means, i.e., clip member 70, is then compressed by being squeezed between thumb and forefinger to bring opposed legs 74*a*, 74*b* close together. While holding it in this compressed state, clip member 70 is advanced towards release means 20, in the direction indicated by the arrows in FIG. 3A, until detent feet 76*a*, 76*b* are respectively aligned with apertures 49 and 49*a* formed in the sidewalls 40, 40*a* of release means 20. Legs 74*a*, 74*b* are then released so that detent feet 76*a*, 76*b* engage, respectively, apertures 49 and 49*a*, as illustrated in FIG. 3C. The resiliency of legs 74*a*, 74*b* will urge them to diverge towards the position indicated in dash lines in FIG. 3C, and consequently seat them firmly within apertures 49, 49*a*, the legs being securely retained in place by sidewalls 40, 40*a*. The completed connection of both supply tube 16 and clip member 70 is illustrated in FIGS. 3B and 3C, and it is seen that clip member 70 will retain trigger 44 in the depressed, open position seen in FIG. 3*b*, thereby holding stem valve 24 in the open position and releasing the discharge of pressurized fluid from chamber 34 through release means 20, thence through supply tube 16 to remote dispenser 14. Since outlet release means 56 provides a positive shut-off for fluid delivered under pressure through supply tube 16, release means 20 of base unit 12 may be left locked by clip member 70 in its open position and the dispensing of the pressurized fluid controlled by trigger 44' (FIG. 5) of outlet release means 56.

The outside diameter of supply tube 16 is sized relative to the diameter of discharge bore 36 to effectuate a sufficiently tight seal between supply tube 16 and discharge bore 36 so that fluid forced under pressure through delivery bore 22*c* and discharge bore 36 enters supply tube 16. Even if tube 16 is a loose fit within discharge bore 36, clip member 70 will securely retain it in place, while holding release means 20 in the open position.

Inadvertent disconnection of supply tube 16 from discharge bore 36 is rendered highly unlikely if not prevented altogether by the seating of clip member 70 with the retainer seat provided by apertures 49, 49*a* in side walls 40, 40*a*. This is due to the gripping strength of the resilient force tending to move compressed legs 74*a*, 74*b* away from each other. This resilient force is determined by the resiliency of the wire from which clip member 70 is fabricated, and the dimension and configuration of the clip and its coil providing bight portion 72. The strength of clip member 70 is selected to be sufficiently high to resist even high stresses imposed upon supply tube 16 during manipulation of remote dispenser 14 by the operator.

It will be observed that detent feet 76*a*, 76*b*, being engaged within apertures 49, 49*a*, result in the axis F (FIG. 2) of clip member 70 comprising a fulcrum about which clip member 70 would, except for the provision of stop member 78, be pivotable. For example, an upward tug on supply tube 16, the force of which is illustrated by the arrow U in FIG. 3B, would tend to cause clip member 70 to pivot along this fulcrum axis F and side walls 40, 40*a* so that, if stop member 78 were lacking, the leverage effect might pull supply tube 16 out of discharge bore 36 even though detent feet 76*a*, 76*b* remain seated in apertures 49, 49*a*. However, such pivoting action is resisted by the downward movement (indicated in FIG. 3B by the arrow D) of stop member 78. Stop member 78 thus serves to stabilize clip member 70 against pivoting within the retainer seat provided by apertures 49, 49*a* and helps to retain clip member 70 in place even if considerable force is exerted against it. Pulls or tugs on supply tube 16 in an axial direction indicated by the arrow P in FIG. 3B, are resisted by the engagement of ferrule 48 against the coil comprising bight portion 72 of clip member 70. The coil of bight portion 72 cooperates with ferrule 48 against the coil comprising bight portion 72 of clip member 70. The coil of bight portion 72 cooperates with ferrule 48 and acts as a stop and strain relief for sheathed supply tube 16, thus protecting tube 16 against excessive flexing and resultant material fatigue and potential failure. Even if a sufficiently high force (such as that represented by arrow P in FIG. 3B) could be applied to sheathed tube 16 so as to pull it from discharge bore 36, the engagement of tube 16 (by means of ferrule 48) with the clip member 70 would tend to pull the latter from its locking seat (apertures 49, 49*a*), thereby automatically freeing trigger 44 to return to its normal closed position to preclude uncontrolled discharge of the pressurized fluid from the base unit 12.

Although clip member 70 is firmly held in place in the locking seat provided by apertures 49, 49*a* and by the strength of its spring-like resiliency, it may be readily and quickly disconnected when desired by simply squeezing between thumb and forefinger legs 74*a* and 74*b* to further compress them to bring them closer together, thereby disengaging detent feet 76*a*, 76*b* from apertures 49, 49*a*, and sliding clip member 70 along supply tube 16 in the direction opposite from that indicated by the arrows in FIG. 3A, thereby freeing trigger 44 to return to its normal position and close stem valve 24. Supply tube 16 may then be removed from discharge bore 36.

While the invention has been described in detail with reference to specific preferred embodiments thereof, it will be appreciated that those skilled in the art, upon a reading and understanding of the foregoing, may readily envision numerous alterations and modifications thereto which alterations and modifications are nonetheless within the spirit and scope of the invention and the appended claims.

What is claimed is:

1. In a remote dispenser for dispensing a pressurized fluid from a base unit defining a chamber containing the pressurized fluid:

(a) the base unit having mounted thereon release means including (i) a valve assembly having a discharge bore in flow communication with the chamber, (ii) a displaceable member moveable between a normally closed position, in which flow of pressurized fluid through the discharge bore is blocked, and an open position in which the discharge bore is open to such flow, and (iii) a support means carrying a retainer seat positioned adjacent the displaceable member; and (b) said remote dispenser including (i) a supply tube having a supply end dimensioned and configured to be slidably and removably connected in fluid flow communication with the discharge bore, and (ii) locking means secured to the supply tube at the supply end thereof and seatable in the retainer seat of said support means, the locking means being dimensioned and configured so that, when seated within the retainer seat, the locking means retains the displaceable member in its open position and secures the supply tube to the discharge bore; the improvement comprising, that the locking means comprises a clip member having (1) an anchor portion within which the supply tube is retained; (2) a pair of spaced-apart, resilient, opposed legs, the clip member being dimensioned and configured so that, (i) when said legs are compressed and then released to resiliently engage said retainer seat, said clip member resiliently grips and thereby engages said support means, and (ii) said clip member is disengageable therefrom by further compression of the legs to disengage them from said retainer seat; and (3) a stop member dimensioned and configured to restrict pivoting movement of said locking means relative to said support means when the locking means is engaged therewith.

2. The dispenser of claim 1 wherein the anchor portion of said clip member comprises a bight from which each of said opposed legs extends.

3. The dispenser of claim 1 wherein each of said legs terminates in a detent foot to provide a pair of detent feet dimensioned and configured to engage said retainer seat.

4. The dispenser of claim 3 wherein the detent feet define a fulcrum portion of the locking means and the stop member and anchor portion extend away from the fulcrum portion on opposite sides thereof.

5. The dispenser of claim 1 wherein the stop member comprises a U-bent portion of one of said legs.

6. The dispenser of claim 2 wherein the locking means is comprised of resilient wire and the bight portion comprises a coiled segment of the wire defining a coil aperture having an inside diameter, and wherein the supply tube is received within the coil aperture.

7. The dispenser of claim 6 including a ferrule affixed to the supply end of the supply tube, the ferrule having an outside diameter greater than the inside diameter of the coil aperture.

8. In a pressurized fluid remote-dispensing assembly comprising (a) a base unit defining a chamber having a discharge aperture and containing fluid under pressure, the base unit having mounted thereon (i) a valve assembly to control discharge of the pressurized fluid from the discharge aperture, the valve assembly including release means having therein a discharge bore in fluid flow communication with the discharge aperture and a displaceable member moveable between a normally closed position in which flow of pressurized fluid from the discharge aperture is blocked by the valve assembly, and an open position in which the discharge aperture is open to such flow, and (ii) a support member having a retainer seat positioned adjacent the displaceable member;

(b) a remote fluid dispenser; and (c) a flexible supply tube connecting the base unit and the remote dispenser in fluid flow communication, the supply tube having a supply end and a delivery end, the supply end being dimensioned and configured to be slidably and removably connected with the discharge bore, and the delivery end being connected to the remote dispenser, whereby the supply tube serves to conduct pressurized fluid from the base unit to the remote dispenser;

(d) locking means secured to the supply tube adjacent the supply end thereof and seated within the retainer formation of the support member, said locking means being dimensioned and configured so that, when thus seated in the support member, the locking means engages the displaceable member and retains it in its open position, and secures the supply tube to the discharge bore; the improvement comprising, that the locking means comprises a clip member having (1) a bight portion within which the supply tube is retained, (2) a pair of spaced-apart, resilient, opposed legs, the legs extending from the bight portion and terminating in respective detent feet dimensioned and configured to engage the retainer seat of the support member, and (3) a stop member dimensioned and configured to restrict pivoting movement of said locking means relative to said support member when the locking means is engaged therewith; the clip member being dimensioned and configured so that (i) compression of the legs enables the clip member to resiliently bias the detent feet into seating engagement with the retainer seat, and (ii) said clip member is disengageable from said support member by further compression of the legs to unseat the detent feet from the retainer seat.

9. The assembly of claim 1 or claim 8 wherein said retainer seat comprises one or more apertures formed in the support means adjacent said displaceable member.

10. The assembly of claim 1 or claim 8 wherein said release means further comprises a manually actuable trigger operable to move said displaceable means and thereby said fluid supply valve to the open valve position.

11. The assembly of claim 1 or claim 8 wherein said remote dispenser comprises a handle means to which the supply tube is sealingly attached and a manually operated nozzle for dispensing therethrough pressurized fluid received from the base unit through the supply tube.

* * * * *